United States Patent [19]

Bachmann

[11] 4,121,107

[45] Oct. 17, 1978

[54] APPARATUS FOR AUTOMATIC LOW-BACTERIA TO ASEPTIC FILLING AND PACKING OF FOODSTUFFS

[75] Inventor: Robert Bachmann, Dottingen, Switzerland

[73] Assignee: BBC Brown, Boveri & Company Limited, Baden, Switzerland

[21] Appl. No.: 788,343

[22] Filed: Apr. 18, 1977

Related U.S. Application Data

[62] Division of Ser. No. 557,259, Mar. 11, 1975, abandoned.

[30] Foreign Application Priority Data

Apr. 10, 1974 [CH] Switzerland ..... 5050/74

[51] Int. Cl.[2] ..... H01J 37/00

[52] U.S. Cl. ..... 250/455; 250/504; 250/492 R

[58] Field of Search ..... 250/492 R, 432, 504, 250/455, 456; 350/288, 299

[56] References Cited

U.S. PATENT DOCUMENTS

| | | | |
|---|---|---|---|
| 2,017,079 | 10/1935 | Steerup | 250/455 |
| 2,058,826 | 10/1936 | Reece | 250/455 |
| 3,026,435 | 11/1962 | McPherson | 250/504 |
| 3,790,801 | 2/1974 | Coleman | 250/455 |
| 3,994,686 | 11/1976 | Ranser et al. | 250/504 |

*Primary Examiner*—Alfred E. Smith
*Assistant Examiner*—B. C. Anderson
*Attorney, Agent, or Firm*—Oblon, Fisher, Spivak, McClelland & Maier

[57] ABSTRACT

The automatic filling and packaging of foodstuffs under aseptic to low-bacterial count conditions is accomplished by disinfecting a packaging material for at least one second by means of high-intensity ultraviolet radiation, generated by a high-current, low-pressure mercury discharge with a current density of more than 1 $A/cm^2$ and a mercury pressure of $5 \times 10^{-3}$ to $5 \times 10^{-1}$ Torr, wherein the spectral radiation intensity of the 253.7 nm line of the ultraviolet radiation UV on the packaging material 1, 2, 3 is set to at least 0.05 $W/cm^2$.

5 Claims, 5 Drawing Figures

APPARATUS FOR AUTOMATIC LOW-BACTERIA TO ASEPTIC FILLING AND PACKING OF FOODSTUFFS

This is a division of application Ser. No. 557,259, filed Mar. 11, 1975 abandoned.

BACKGROUND OF THE INVENTION

1. Field of the Invention

The present invention relates to a method and apparatus for the automatic filling and packaging of foodstuffs under aseptic or low-bacterial count conditions, which foodstuffs have been previously disinfected or sterilized and then passed to a filling and packing plant. The packaging material is disinfected by means of high-intensity ultraviolet radiation.

2. Description of the Prior Art

Automatic techniques for the aseptic filling and packaging of foodstuffs is being used on an increasingly wide scale. To date, the aseptic packing of pre-sterilized (uperised) milk in packages made of a composite paper material has gained particularly wide acceptance. (The uperisation of milk is described, for example, in Industr. alim, agr. 1956, p. 635–640.) The packages are predominantly tetrahedral or rectangular in shape and are made up by applying transverse seals to a tube of packaging material formed from a strip of packaging material drawn from a roll (cf. TARA 271, February 1972, page 104).

Generally, "aseptic packing" can also be defined as the placing of a cold, commercially sterile foodstuff into a pre-sterilised container under sterile conditions. The container, if provided with an appropriately pre-sterilized lid is enclosed in a sterile environment so as to produce an airtight package (Food Technology, August 1972, page 70).

Another packaging technique which has become very important is the packaging of low-bacteria count foodstuffs in, for example, deep-drawn prefabricated beakers which are then heat-sealed with refined aluminum foil. Common applications include the packing of yoghourt, soured milk, cream, and so on. An essential feature of the known techniques is that no sterilization occurs of the contents by heating in the already sealed package, as is the case with canning and preserving techniques. The tedious heating process is thus eliminated without having to take into account deleterious changes in the contents of the packaged foodstuff such as flavour or composition. Furthermore, the packages can be made of materials, in particular plastics, which cannot withstand elevated temperatures. A particularly critical aspect of the known techniques is that the packaging material must be so free from bacteria as to provide the greatest possible safeguard against infection of the previously sterilized or disinfected contents by bacteria, moulds and/or yeasts which could cause spoiling. Here it is pertinent to note that in the case of uperised milk, for example, a single bacterium in the package can cause the milk to spoil.

A large variety of methods and apparatus for disinfecting packaging materials have been proposed and applied in practice. These are reviewed, for example, in "Verpackungs-Rundschau" 7 (1970) pages 51–54. Other references in the literature include Food Technology, September 1973, page 49 (disinfection with alcohol and ultraviolet radiation) and Food Technology, August 1972, pages 70–74 (e.g. disinfection with wet and high-temperature steam, the so-called "James Dole process"). In particular, a method is known as described in "Verpackungs-Rundschau" 7 (1970) page 52–53, whereby packaging material is disinfected by means of high-intensity ultraviolet radiation. It is disclosed that the ultraviolet wavelength of 254 nm has proven especially effective against all relevant micro-organisms. However, micro-organisms differ with regard to their sensitivity to ultraviolet radiation. Thorough destruction of all micro-organisms present can be achieved only with a very heavy radiation dose. On page 54, op. cit., it is disclosed that the high destruction rates are obtained only when the distance of the foodstuff from the light source is very short. Further, it is not known whether or how packages can be sterilized to the required degree and at a sufficient speed as required in filling plant operations.

A need therefore continues to exist for a method of packaging foodstuffs under sterile conditions by exposure of the packing material to a sterilizing light source such that the degree of sterilization is swift and complete.

SUMMARY OF THE INVENTION

Accordingly, one object of the present invention is to provide a method by which packaging material can be disinfected on an industrial scale by means of ultraviolet radiation on filling and packing machines.

Briefly, this object and other objects of the present invention, as hereinafter will become more readily apparent, can be obtained in a method of filling and packaging foodstuffs under aseptic or low-bacteria count conditions by disinfecting a packaging material for at least one second by means of high-intensity ultraviolet radiation generated by a high-current, low-pressure mercury discharge with a current density of more than 1 A/cm$^2$ and a mercury pressure of $5 \times 10^{-3}$ to $5 \times 10^{-1}$ Torr, wherein the spectral radiation intensity of the 253.7 nm line of the ultraviolet radiation on the packaging material is set to at least 0.05 W/cm$^2$.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A mercury discharge of the kind described above produces ultraviolet radiation having a spectrum which causes destruction of the relevant micro-organisms in a surprisingly effective manner. Although control of the radiation intensity is aimed basically at the 253.7 nm line, it is important that the ultraviolet spectrum should also contain significant proportions of the 184.9 and 194.2 nm lines. If the stated minimum radiation intensity and minimum time of exposure of the packaging materials to the ultraviolet are observed, the packaging material is surprisingly disinfected to an extent which, in contrast to previous general expectations, makes disinfection by means of ultraviolet radiation practical on an industrial scale.

Figure 1:
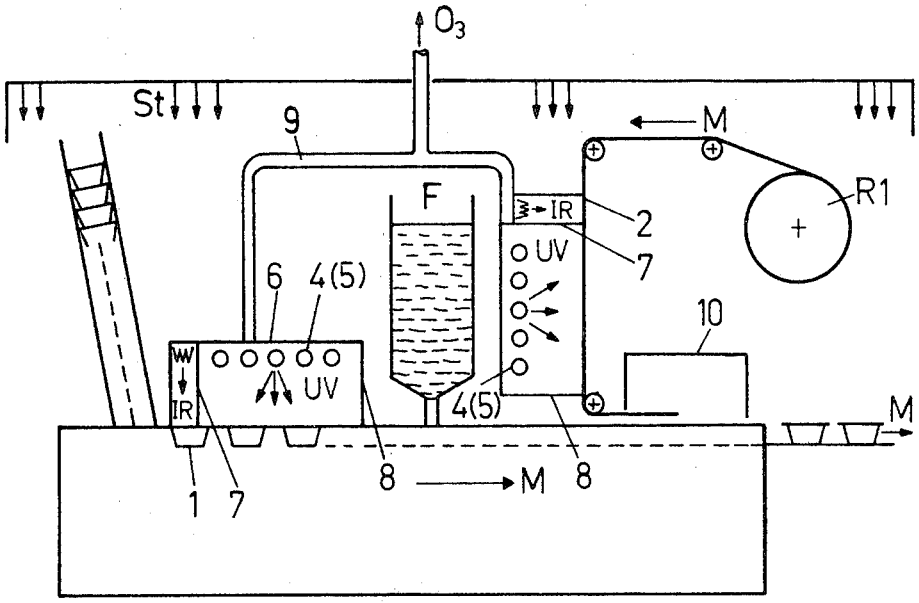
FIG. 1 shows a filling and packaging plant for the packaging of portion-sized packages of low-bacteria content.

In FIG. 1 the packing material 1 in the form of preshaped containers, e.g. deep-drawn beakers, is taken from a stack and conveyed in direction M. The packing material 1 is first exposed to infrared radiation IR and then to ultraviolet radiation UV from the discharge paths 5 of discharge tubes 4 located in a housing 6, 7, 8 which acts as a reflector. The reflector housing containing the UV radiation source is also termed the UV channel. Under the filling station F the portion-size beakers are filled with the previously disinfected contents, e.g. yoghourt or cream. Packing material 2, a sealing foil of aluminium 50–100 $\mu$m thick, for example, running off a roll R1, is first, like material 1, passed through an infrared channel and an ultraviolet channel, and is then fed via a guide roll to the stamping and sealing station 10. Here, lids are stamped from the sealing foil and attached to the filled beakers by heat to give an airtight seal. The completed portion-size packs then leave the machine on the right.

To keep the plant generally aseptic, sterile air S*t* is blown into the packaging area from above. This air could also be introduced horizontally from the side.

Figure 2:
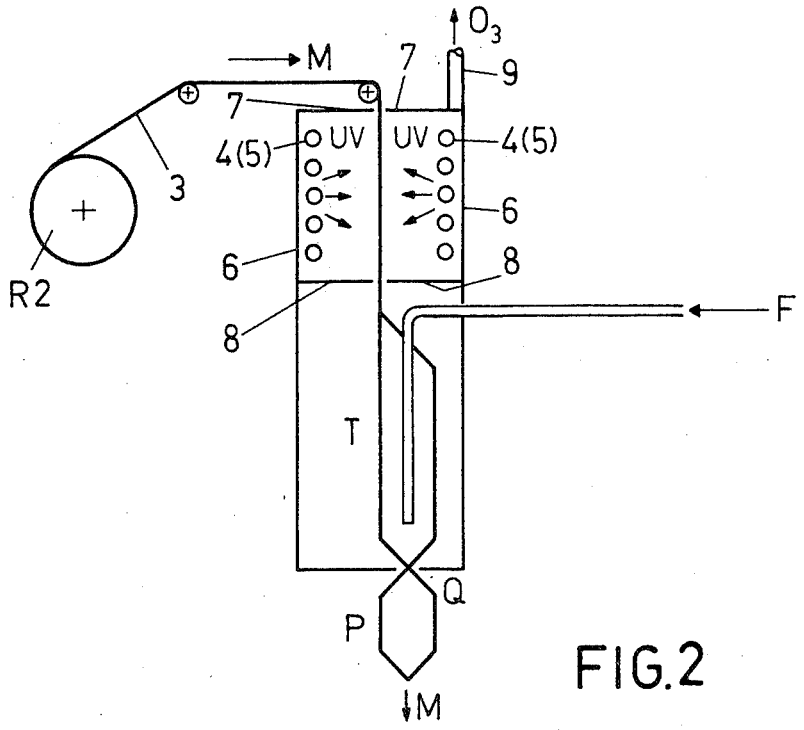
FIG. 2 shows a filling and packing plant for the aseptic packaging of a pre-sterilized liquid, such as uperised milk.

In FIG. 2, packing material 3, e.g. a laminated paper composite with plastic-coated aluminium foil, runs from roll R2 in direction M into a UV channel comprising two reflector housings 6, 7, 8 with discharge tubes 4 arranged on either side of the packing material 3. The packing material 3 is then shaped in a device (not shown) into a tube T, transversely sealed at Q, and then ejected as a finished package P. The liquid contents of the package are fed into the packaging material through conduit F, a pipe which is introduced into the shaped tube. As in FIG. 1, the apparatus of FIG. 2 can also be provided with an IR channel before the UV channel.

The discharge tubes 4 are provided so that the packaging material 1, 2, 3, in whatever form it occurs, is exposed to radiation of the correct intensity and with the wavelength spectrum specified by the invention. The tubes are conveniently of the form described in Swiss Patent application No. 2994/74 (German Patent application No. P 24 12 997.3), to which reference is made as appropriate. The desired ultraviolet radiation is emitted from the part of the discharge tube 4 denoted "discharge path 5".

Figure 3:
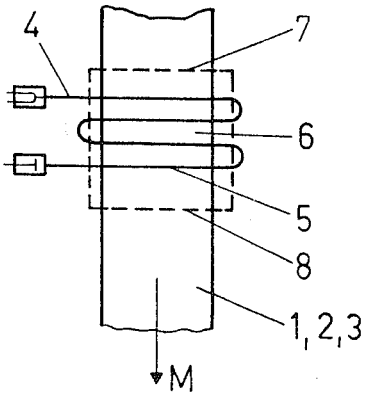
FIG. 3 shows in schematic form the arrangement of a folded discharge tube over a feed line of packaging material.

FIG. 3 shows a folded discharge tube 4 over a feed line of packing material 1, 2, 3. Each part of the discharge tube 4 extending over the full width of the packing material 1, 2, 3 is to be considered as a discharge path 5, and thus the folded discharge tube 4 shown has four discharge paths 5 arranged in series and extending over the whole width of the packing material 1, 2, 3.

The procedure of disinfection by means of ultraviolet radiation is as follows: The discharge tubes 4 are operated for example at 10 A/cm$^2$ with a mercury temperature of 72° C, corresponding to about $6 \times 10^{-2}$ Torr. In this manner, intense ultraviolet radiation of wave-length 253.7 nm is generated with an efficiency of more than 20%, whereby the spectrum also includes substantial proportions of the lines 184.9 and 194.2 nm. At these wavelengths of radiation, as will be described more fully below, all sporogenetic and non-sporogenetic bacteria are killed at the required rate within a few seconds, while mould spores, particularly aspergillus niger, are more resistant.

It is often not necessary to kill all of the mould spores present in a foodstuff, as the spores are neither toxic nor pathogenic and, in sealed packages of milk for example, are also virtually incapable of multiplying. If destruction of the mould spores is desirable, however, it is achieved in accordance with another important aspect of the invention by heating the packing material 1, 2, 3, to more than 60° C, e.g. to 80°–90° C in the sterile part of the filling and packing plant. It is known that mould spores are destroyed completely at such temperature within a few seconds.

The packaging material 1, 2 is heated as shown in FIG. 1 by means of infrared radiation IR before the packing material is subjected to the ultraviolet radiation UV. The infrared radiation section can be kept short because the temperature created by the infrared radiation is retained in the UV channel owing to the dissipation of UV power, and even rises a few degrees, and thus the packing material is held for a sufficiently long time at the temperature necessary to kill the mould spores.

The dosage of UV radiation tested in practice (cf. DIN 5031 Sheet 1, August 1970, para. 7) on packing materials is 1.5 Ws/cm$^2$, although the measurement relates only to the 253.7 nm line. Taking into account the technically and industrially reasonable feed rates for the packaging material, irradiation of the packaging material with an intensity on the 253.7 nm line of 0.3 W/cm$^2$, and exposure of the material to the UV radiation of 5 seconds, has proven advantageous.

In order that the discharge tubes 4 emit not only 253.7 nm radiation, but also 183.9 nm and 194.2 nm radiation, the discharge paths 5 are provided with substances which do not absorb these lines. Such a substance is high-purity quartz, e.g. synthetic quartz. This not only makes available the ultraviolet spectrum important for killing micro-organisms, but also causes ozone $O_3$ to be generated in considerable quantities from atmospheric oxygen. The presence of $O_3$ has an added sterilizing effect on the packaging material and the surroundings.

It is very important that the feed line of the packaging material, regardless of its form (containers, flat strip), be irradiated uniformly and homogeneously. Achieving this has hitherto presented a serious practical problem. But here, too, the invention offers an effective remedy. Homogeneous irradiation transverse to the direction of movement M of the packing material 1, 2, 3 is obtained by arranging the straight sections of the discharge tubes 4, i.e. the discharge paths 5, so that they extend across the full width of the line of packaging material and lie in series in a plane E parallel to the plane of the irradiated line of packaging. Arranging the discharge paths 5 in series transverse to direction M has the further advantage that any unequal ageing of the discharge paths is compensated more effectively. Homogeneous distribution over a defined distance in the direction of movement M is achieved by means of a reflector. This is highly reflective for the short-wave ultraviolet and consists of highly polished anodised aluminium, for example. Its reflectivity is better than 0.75. The reflector comprises an upper portion 6 and two side pieces 7, 8. These extend from the upper portion 6, preferably vertically, towards the feed line of packing material 1, 2, 3. Side piece 7 is at the entrance of the UV channel, and side piece 8 at the exit.

This arrangement of the reflector not only creates a defined radiation section, but also produces highly homogeneous and diffuse radiation on the packaging material in a manner not immediately predictable. One reason for this at first surprising result is that the high-current low-pressure mercury discharge as operated with the parameters of the invention is optically narrow, i.e. the radiation comes uniformly from the whole volume of the discharge, and no absorption takes place. The optical laws for point, line and area sources cannot, therefore, be applied to a reflector of this kind.

The discharge paths 5 and the reflector 6, 7, 8 are advantageously arranged in a housing having openings to the outside which are as small as possible and form a seal as tight as possible at the entry and exit of the packaging material 1, 2, 3. This housing screens the surroundings from the UV radiation and also prevents dissipation of the ozone produced by the radiation, particularly in the direction of the filling station F. The housing can also consist of the reflector itself 6, 7, 8, as shown in FIGS. 1 and 2.

Figure 4:
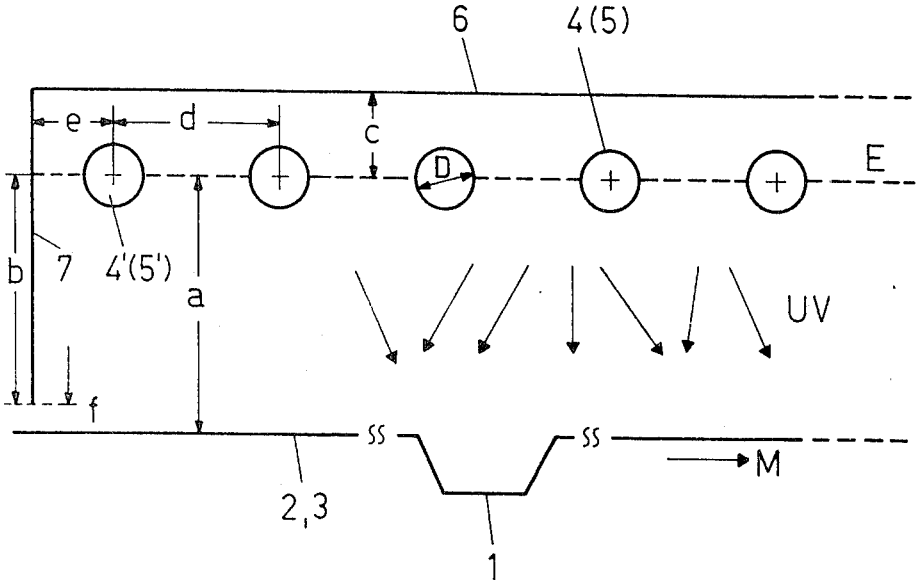
FIG. 4 illustrates discharge tubes in a reflector over a feed line of packaging material.

The housing or the reflector can be equipped with an exhaust device 9 for the ozone formed. The electrode spaces of the discharge tubes 4 are conveniently outside the housing or reflector, located side by side in a special lamp enclosure. The reflector must be of a suitable shape and size so that the UV radiation at the packaging material is as homogeneous and diffuse as possible. The method of determining such dimension is described with reference to FIG. 4:

In order that the radiation intensity I on the packaging material fluctuates by less than 10%, i.e. $\Delta I/I = 10\%$, the condition: $a/d \geqq 0.5$ must be observed when using a reflector of reflectivity $R \geqq 0.75$. Here, $a$ is the vertical distance between the axis of a discharge path 5 and the packing material 1, 2, 3. The vertical distance $c$ of plane E in which the discharge paths lie is itself of secondary importance, but it should be as small as possible, and in particular smaller than the distance $d$ between the axes of two discharge paths. Edge effects can then be more effectively avoided.

Also to minimize edge effects, $e$ should be as small as possible, and $b$ as large as possible. Here, $e$ is the shortest distance between the axis of the outermost discharge path 5' and the neighbouring side piece 7, 8, and $b$ is the length of a side piece 7, 8 from plane E towards the packaging material. If, in particular, $e < 1.5$ D (where $D$ = diameter of discharge path 5) and $a-b = f <$ 10mm, then $\Delta I/I \leqq 10\%$ over the entire line of packaging material 1, 2, 3 from inlet side piece 7 to outlet side piece 8.

Homogeneous and diffuse ultraviolet radiation as described above have the following advantages, among others:

The interior of preformed containers is uniformly irradiated, in particular without shadows. Surprisingly, the interior of beakers 3 cm deep and 6 cm wide is disinfected at all points just as quickly as a flat strip (with the same discharge tubes and the same reflector).

The discharge tubes 4 do not have to be matched to a certain feed rhythm, i.e. it is immaterial at which point of the irradiated area a preformed container stops between feed movements.

Having generally described this invention, a further understanding can be obtained by reference to certain specific examples which are provided herein for purpose of illustration only and are not intended to be limiting unless otherwise specified.

Figure 5:
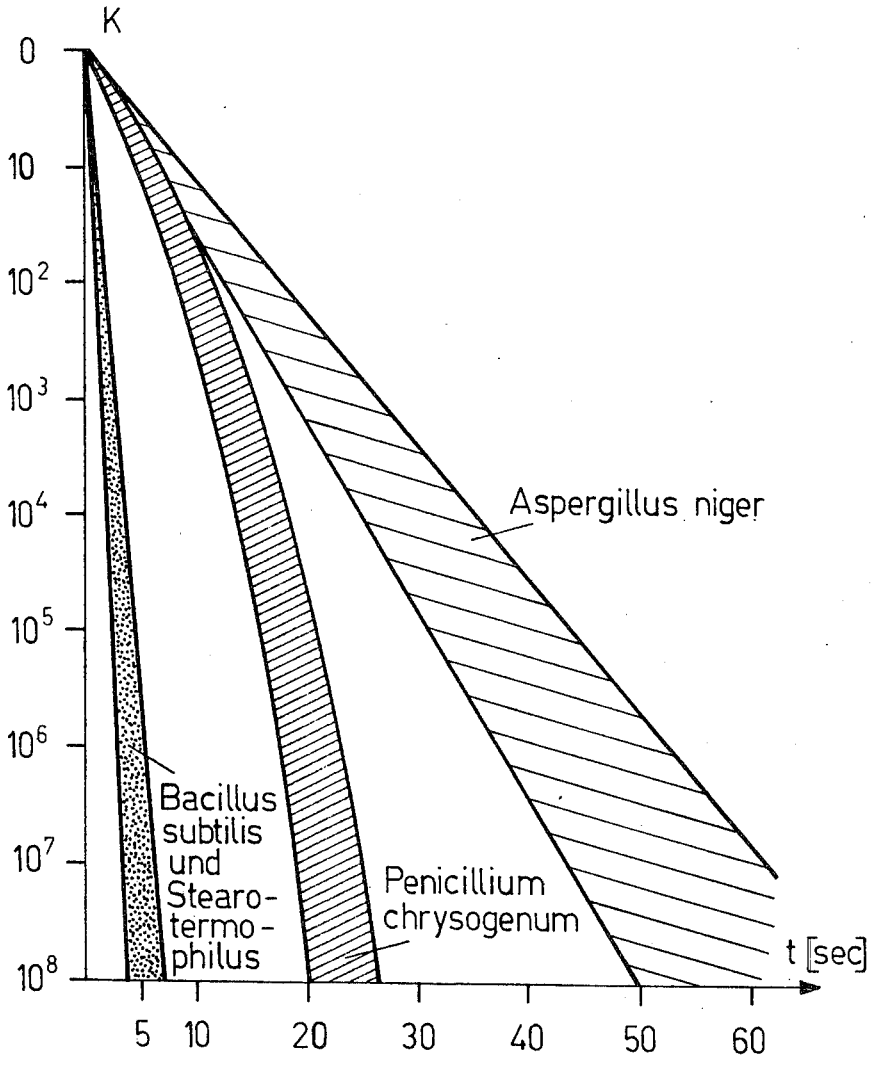
FIG. 5 is a diagram showing the destruction rate K of various relevant micro-organisms in relation to the exposure time $t$ of the packaging material to ultraviolet radiation, at a radiation intensity of 0.3 W/cm$^2$.

FIG. 5 shows the results of microbiological disinfection tests. A low-pressure high-current mercury discharge of 10 A/cm$^2$ and $6 \times 10^{-2}$ Torr was used, with a radiation intensity on the 253.7 nm line of 0.3 W/cm$^2$ at the test substrate.

Refined spore cultures of the tested bacteria moulds were applied to define surfaces in defined dilutions in the range $10^3$–$10^8$ per smear, and partly dried. The cultures were then exposed for different times to the ultraviolet radiation, and afterwards washed off and incubated. The reduction of microorganisms was then determined with the aid of absolute sterility tests.

Tests were performed for the following organisms:

*Bacillus subtilis* (spores)
*Bacillus stearothermophilus* (spores)
*Escherichia coli*
*Mucor mucedo*
*Aspergillus Niger*
*Penicillium chrysogenum*

*Escherichia coli* and *Mucor mucedo* were reduced in 2 to 3 seconds at a rate K of more than $10^8$. The results for the other micro-organisms tested can be seen in FIG. 5.

With a spectral (253.7 nm) radiation intensity of 0.3 W/cm$^2$, the effect of the total short-wave UV radiation is such that

- all sporogenetic bacteria with a radiation time of 5 seconds undergo a reduction rate $> 10^6$ (Subtilis and Stearothermophilus most resistant) with initial counts of up to $10^8$ on areas $\leqq 1$ cm$^2$,
- with a radiation time of 5 seconds all non-sporogenetic bacteria undergo even much higher reduction rates, and
- in the case of mould spores, radiation times of up to 30 seconds are necessary (*Aspergillus Niger* most resistant) to achieve high reduction rates ($\geqq 10^4$).

In accordance with the invention, the combined infrared/ultraviolet technique as described above is used to avoid the possibly long times necessary to destroy mould spores. For the sake of completeness it may also be mentioned that it would be perfectly practical to irradiate packaging materials 1 and 2 of FIG. 1 on both sides, i.e. not only on the contents side, but also on the outside. This would eliminate the danger of the sterile space becoming infected by the packing material.

The method of the invention, together with the apparatus for implementing it, is used with particular success for filling and packing liquids or pastes in soft or semi-rigid containers, and thus especially for packing up arised milk in continuous-tube type containers, or for placing yoghourt, soured milk, cream, etc. in portion-sized packages. Hitherto, disinfection with steam or hydrogen peroxide $H_2O_2$ has been mainly used in these cases. But steam disinfection presents serious mechanical problems because the steam is highly corrosive. Disinfection with $H_2O_2$ presents a further problem in that there must be adequate safeguards to keep the chemical away from the food so that the method can be at least legally acceptable. None of these problems arise with the method and apparatus of the invention.

Since with portion-sized packages the foil cover is colored and covered with printed matter, and since the packages are particularly susceptible to distortion, the use of UV disinfection according to the invention for the foil cover is of very special significance. It is also possible to employ a classical method of disinfection, e.g. the $H_2O_2$ technique, for less sensitive containers, and disinfect only the cover foil with ultraviolet.

Having now fully described this invention, it will be apparent to one of ordinary skill in the art that many changes and modifications can be made thereto without departing from the spirit or scope of the invention as set forth herein.

What is claimed as new and desired to be secured by Letters Patent of the United States is:

1. An apparatus for automatically filling and packaging foodstuffs under aseptic to low-bacterial count conditions, said foodstuffs having been previously disinfected or sterilized, comprising:

at least two mercury discharge tubes having a high-current, low-pressure mercury discharge with a current density of more than 1 $A/cm^2$ and a mercury pressure of $5 \times 10^{-3}$ to $5 \times 10^{-1}$ Torr, the discharge tubes having discharge paths, the material surrounding the discharge paths within the discharge tubes being transparent at least for the wavelength 253.7 nm;

means for passing a packaging material to a station for receiving said foodstuffs;

means for applying the spectral radiation intensity of the 253.7 nm line of the ultraviolet radiation of the discharge tubes on the packaging material with at least 0.05 $W/cm^2$, the discharge tubes being arranged one behind the other relative to the direction (M) of movement of said packaging material toward said station and extending across the entire width of said packaging material, said discharge paths of said discharge tubes lying in a plane (E) parallel to the plane of the irradiated portion of said packaging material, said radiation applying means including a reflector formed of an upper part disposed above and parallel to the plane of said discharge paths, and two side parts extending from said upper part to a line of said packaging material at those points at which said ultraviolet radiation begins and ends, respectively, the reflectivity of the reflector being better than 0.75 and said two side parts being approximately perpendicular to said upper part, wherein the ratio of the vertical distance (*a*) between the plane (E) of the discharge paths and the packaging material to the distance (*d*) between two adjacent discharge paths is at least 0.5, the shortest distance (*e*) between the two outer discharge paths and the adjacent side parts is smaller than twice the diameter (D) of one discharge tube and the shortest distance (*f*) between the side parts and the packaging material is less than 10 mm.

2. The apparatus as recited in claim 1, wherein:

the vertical distance (*c*) between the plane (E) of the discharge paths and the upper part of the reflector is smaller than the distance (*d*) between two adjacent discharge paths.

3. The apparatus recited in claim 1, wherein the material of said discharge tubes surrounding said discharge paths is transparent at least also for the wavelengths 184.9 nm and 194.2 nm.

4. The apparatus as set forth in claim 3, including:

a housing enclosing said discharge tubes and said reflector down to the line of packaging material; and means for extracting ozone ($O_3$) from said housing.

5. The apparatus as recited in claim 2, wherein the material of said discharge tubes surrounding said discharge paths is transparent at least also for the wavelengths 184.9 nm and 194.2 nm.

* * * * *